US006454859B1

(12) United States Patent
Bernert et al.

(10) Patent No.: US 6,454,859 B1
(45) Date of Patent: Sep. 24, 2002

(54) CURTAIN APPLICATOR

(75) Inventors: Richard Bernert, Giengen; Manfred Uebarschär, Gerstetten, both of (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/961,039

(22) Filed: Sep. 21, 2001

(30) Foreign Application Priority Data

Sep. 22, 2000 (DE) ..... 100 47 167

(51) Int. Cl.[7] ..... B05C 3/02

(52) U.S. Cl. ..... 118/410; 118/325; 118/62; 118/DIG. 4

(58) Field of Search ..... 118/410, 325, 118/62, DIG. 4, 44; 427/420

(56) References Cited

U.S. PATENT DOCUMENTS

| | | | | |
|---|---|---|---|---|
| 4,479,987 A | 10/1984 | Koepke et al. | ..... | 427/402 |
| 4,559,896 A | 12/1985 | Bossard et al. | ..... | 118/300 |
| 4,683,027 A | 7/1987 | Pitkäjärvi | ..... | 162/199 |
| 4,830,887 A | 5/1989 | Reiter | ..... | 427/420 |
| 4,924,802 A | 5/1990 | Knop | ..... | 118/410 |

FOREIGN PATENT DOCUMENTS

| | | | | |
|---|---|---|---|---|
| DE | 197 35 588 A1 | 2/1999 | ..... | D21H/23/48 |
| EP | 0 617 167 A1 | 9/1994 | ..... | D21H/23/34 |
| WO | WO 98/47630 | 10/1998 | ..... | B05D/1/30 |
| WO | WO 98/48113 | 10/1998 | ..... | D21H/23/48 |
| WO | WO 99/09253 | 2/1999 | ..... | D21H/23/48 |

OTHER PUBLICATIONS

Database WPI, Section CH, Week 200133 Derwent Publications Ltd., London, GB; XP002179456.

*Primary Examiner*—Brenda A. Lamb
(74) *Attorney, Agent, or Firm*—Taylor & Aust P.C.

(57) ABSTRACT

An apparatus for applying liquid of a pasty application medium to a moving web includes a curtain applicator unit, which discharges the application medium onto the web as a curtain or veil which moves substantially under the force of gravity, and a device which at least prevents complete coverage of at least one of the edge strips of the web over a predetermined width. According to the invention, this device deflects the at least one edge strip out of the plane of the web, at least in the area of the curtain applicator unit.

22 Claims, 2 Drawing Sheets

CURTAIN APPLICATOR

BACKGROUND OF THE INVENTION

1. Field of the Invention

The invention relates to an apparatus for applying liquid of a pasty application medium to a moving web, and more particularly a curtain applicator unit, which discharges the application medium onto the web as a curtain or veil.

2. Description of the Related Art

An apparatus for applying liquid of a pasty application medium is disclosed, for example, by WO 98/48113 which is incorporated by reference. Wherein, the excess application medium applied to the edge strips of the web is sucked away from these edge strips. According to an alternative design variant, aperture-stop elements are provided which catch the application medium in the area of the edge strips and in this way do not permit the edge strips to be wetted with application medium. The desire for a reduction in the coverage of the edge strips with application medium is rooted in the desire to eliminate contamination on supporting elements, such as supporting rolls and deflection elements such as deflection rolls which come into contact with the web. The apparatuses which are necessary to clean these elements not only need installation space but also increase the cost of construction and complicate the operating sequence of the overall plant.

The same drawbacks also exist in the systems disclosed by WO 98/47630 and WO 99/09253 each of which are incorporated herein by reference. Wherein adjustable elements, for catching the application medium are provided, just above the web in the transverse direction, in the area of the edge strips of the web.

SUMMARY OF THE INVENTION

The invention comprises, in one form thereof, an apparatus which prevents complete coverage of at least one of the edge strips of the web over a predetermined width by deflecting the at least one edge strip out of the plane of the web in the area of the curtain applicator unit. The invention is based on the finding that the deflection of the edge strip out of the plane of the web is sufficient to determine the level of coverage or the coverage transverse profile of the edge strip or to completely avoid the coverage of the edge strip. Therefore, according to the invention, it is possible to dispense completely with aperture-stop elements, that are susceptible to contamination, which are used in the prior art discussed above. As will be explained in more detail below, the deflection device can be arranged in such a way that it is not exposed to risk of contamination from the curtain of application medium or the application medium spray.

In order to achieve the desired level of coverage or the desired coverage transverse profile of the edge strip, the deflection device influences the magnitude and the shape of the deflection of the edge strip.

If residual coverage of the edge strip is permitted (preferably decreasing toward the marginal edge of the web) this can be achieved by the deflection device deflecting the edge strip in such a way that it is deflected through an acute angle in the area of the curtain of application medium. Without taking into account the transverse distribution effects of the application medium, as it is applied to the web, and without taking into account the course of the web in the transition region between the edge strip and the useful strip of the web, the level of coverage in the area of the edge strip, as compared with the application in the area of the useful strip, is reduced by a factor corresponding to the cosine of the acute angle.

If the edge strip is to remain completely uncovered, then the deflection device deflects the edge strip through an obtuse angle in the area of the curtain of application medium. In this configuration the edge strip is "folded in" under the useful strip of the web, such that the useful strip acts as an "aperture-stop element" thereby preventing the coverage of the edge strip. However, the coverage of this "aperture-stop element" with application medium, is a desired coating with application medium.

According to an embodiment of the invention, the deflection device deflects the edge strip mechanically.

The deflection device includes at least one deflection rod, which acts on the edge strip side facing away from the deflection direction. The deflection rod is arranged to be pivotable about an axis running substantially parallel to the running direction of the web. The deflection rod may be fixed at specific pivoting intervals or be continuously pivotable into desired positions, thereby setting the level of deflection of the edge strip.

To deflect the edge strip gradually, and increasingly, out of the plane of the web, in the running direction of the web, a plurality of deflection rods are provided. The deflection rods are arranged following one another in the running direction of the web.

According to another embodiment of the invention, the deflection device includes at least one deflection strip. The deflection strip acts on the edge strip side facing away from the deflection direction and deflects the edge strip increasingly out of the plane of the web in the running direction of the web. Such a deflection strip is suitable for influencing the shape of the deflection of the edge strip.

Since the at least one deflection rod or the at least one deflection strip is in sliding contact with the web, it is formed from a wear-resistant material.

The at least one deflection rod or the at least one deflection strip may be detachably fitted, to a holder.

In order to avoid contamination of the deflection rod or the deflection strip with application medium the at least one deflection rod or the at least one deflection strip, as viewed in the running direction of the web, is arranged upstream of the position of the curtain applicator unit. The deflection rod or deflection strip is located between about 1 cm and about 20 cm upstream of the position of curtain applicator unit.

According to another embodiment of the invention, the deflection device deflects the edge strip by influencing the air pressure prevailing in the area of the edge strip.

The deflection device includes at least one blowing device whose blowing nozzle is aimed at the edge strip. To stabilize the transition region between the edge strip and the remainder of the web, a blowing nozzle, on the side of the web facing the deflection device, is aimed at the transition region.

As an alternative to the use of blowing devices for deflecting the edge strip and/or for stabilizing the transition region between the edge strip and the remainder of the web, suction devices can be used.

According to another embodiment of the invention, the deflection device can comprise a web moisture influencing device, which deliberately moistens and/or dries the web in predetermined areas of the web. This web moisture influencing device can advantageously act on the transition region between the edge strip and the remainder of the web. For example, the web can be moistened deliberately on its surface facing away from the deflection direction, causing it to swell up locally. Additionally or alternatively, it can be deliberately dried on the surface of the web facing in the deflection direction, causing it to contract. The deliberate moistening and/or drying causes the web to deform resulting in the desired deflection.

In order to ensure the desired shape and the desired level of deflection of the edge strip, for each of the alternative embodiments discussed above, the relative position of the deflection device is adjustable with respect to the web. This allows optimization of the relative position of the deflection device during operation. Furthermore, the deflection device can also be pivoted from the area of the web, for example to facilitate the threading of the web.

To be able to ensure the controlled return of the edge strip into the plane of the web, a deflection or return device can also be provided downstream of the curtain applicator unit in the running direction of the web. This return device can in principle be constructed in the same way as one of the embodiments of the deflection device described above, with the difference being that it does not deflect the edge strip out of the plane of the web, rather it guides it back into the plane of the web.

BRIEF DESCRIPTION OF THE DRAWINGS

The invention will be explained in more detail below using exemplary embodiments and with reference to the appended drawings, in which.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
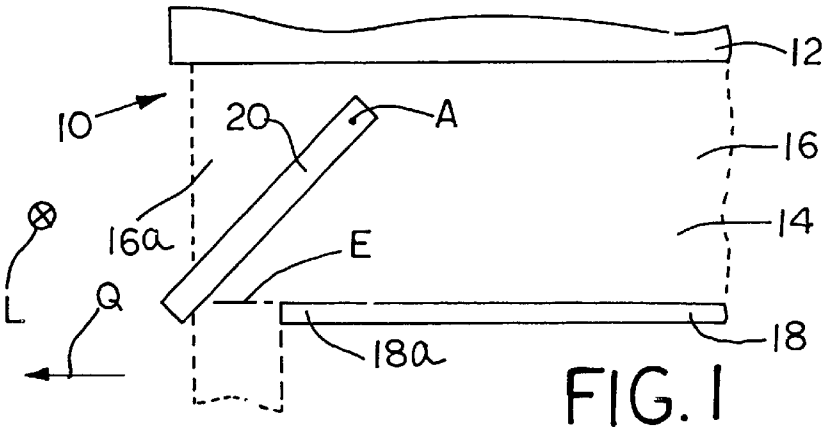
FIGS. 1 to 6 are illustrations to explain the construction and the function of a mechanically operating deflection device and the application result achieved with it.

Referring now to the drawings, and more particularly to FIG. 1, an applicator 10 according to the invention is shown. Applicator 10 includes a curtain applicator unit 12, which is represented only schematically in FIG. 1, which discharges an application medium 14 onto a web 18 in the form of a curtain or veil 16, substantially under the force of gravity. Web 18 moves in a direction L which is substantially orthogonal to the plane of the drawing, into the plane of the drawing.

The purposes of using curtain application unit 12 is to apply to web 18 precisely the amount of application medium which is intended to remain thereon. This differs from the mode of operation which has previously been widespread, in which application medium 14 was applied to web 18 in great excess, with excess application medium 14 being doctored off from web 18 in a further process.

In order to avoid contamination of supporting rolls, deflection rolls or like elements coming into contact with the web, during the coating of web 18, with application medium 14, it is desirable to not apply application medium 14 to edge strip 18*a* of web 18 at all or to apply application medium 14 only to a slight extent. The problem of using curtain applicator unit 12 in this connection consists of the fact that curtain 16, of application medium 14, as measured in transverse direction Q of web 18, is intended to have a greater width than web 18. The aim of this greater dimension is to use only a central portion of curtain 16, of application medium 14, for coating web 18, since the thickness of curtain 16, of application medium 14, in running direction L, in the area of edges 16*a*, is influenced by constriction effects and the like and therefore the coating of web 18 to the desired thickness or with the desired grammage or coat weight cannot be ensured.

According to one embodiment of the invention, edge strips 18*a* of web 18 are deflected out of plane E of web 18, thus permitting them to be covered to a lesser extent or to permit the complete avoidance of their coverage with application medium 14.

A deflector rod 20 is arranged upstream of the position of curtain applicator unit 12, in running direction L, such that it can be pivoted about axis A, running substantially parallel to running direction L. As can be gathered from FIGS. 1, 3 and 5, deflection rod 20 can be fixed in various pivoting positions, in order to selectively act on edge strip 18*a* of web 18.

Figure 2:
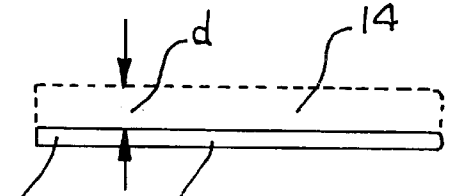

As shown in FIG. 1, deflection rod 20 is not in contact with web 18 or with edge strip 18*a*. This results in web 18 being covered with the same layer of thickness of application medium 14 over its entire width, as shown in FIG. 2, that is to say edge strip 18*a* is also covered with application medium 14.

Figure 3:
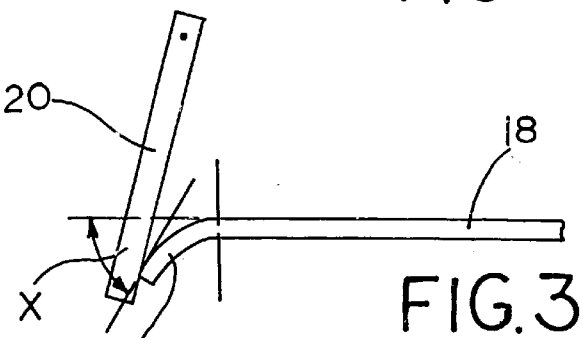
Figure 4:
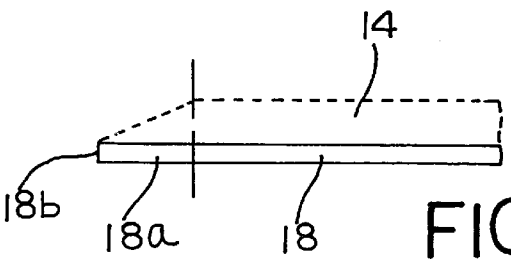

Now, additionally referring to FIG. 3, deflection rod 20 is set lightly against edge strip 18*a* of web 18, causing it to deflect edge strip 18*a* in the direction of arrow R, that is to say downward. Edge strip 18*a* forms an acute angel a with plane E of web 18. Because of the oblique position of edge strip 18*a* in relation to the falling direction of curtain 16 of application medium 14, this leads to a lower coverage of material web 18 with application medium 14, that is to say, more precisely, to a coverage which decreases toward edge 18*b* of web 18 as illustrated in FIG. 4.

Figure 5:
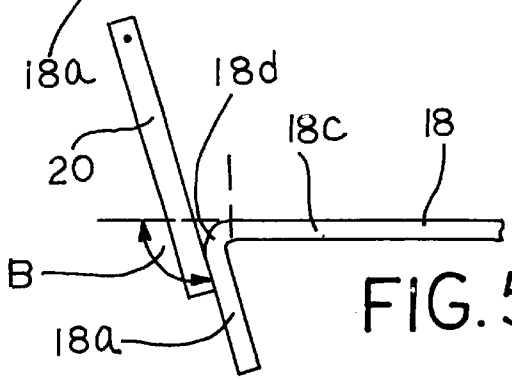
Figure 6:
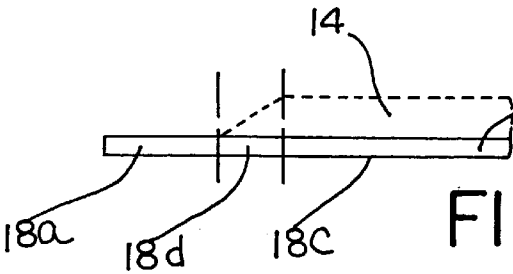

If deflection rod 20 is set against edge strip 18*a* to such a great extent that edge strip 18*a* is bent back under usable area 18*c* (oblique angle β; as illustrated in FIG. 5), then usable area 18*c* acts, so to speak, as an "aperture-stop element", which prevents the coverage of edge strip 18*a*. In transition section 18*d*, between edge strip 18*a* and useful strip 18*c*, a decrease in coverage of web 18 with application medium 14 occurs as illustrated in FIG. 6.

According to the sequence of FIGS. 1, 3 and 5, edge strip 18*a* of web 18 is bent gradually and increasingly toward curtain applicator unit 12 in order to prevent excessive loading of web 18 as a result of bending over edge strip 18*a* abruptly. In the process, it is not necessarily required for edge strip 18*a* to be folded back under useful strip 18*c* of web 18 in a state of maximum deflection, as shown in FIG. 5.

The gradual deflection of the edge strip 18*a* is carried out, by a multiplicity of deflection rods 20 arranged one behind another in running direction L of material web 18. Alternatively, this plurality of deflection rods 20 can be combined into a single deflection strip, whose angle of attack with respect to web 18 or edge strip 18*a* increases with progressive proximity to the position of curtain applicator unit 12.

Figure 7:
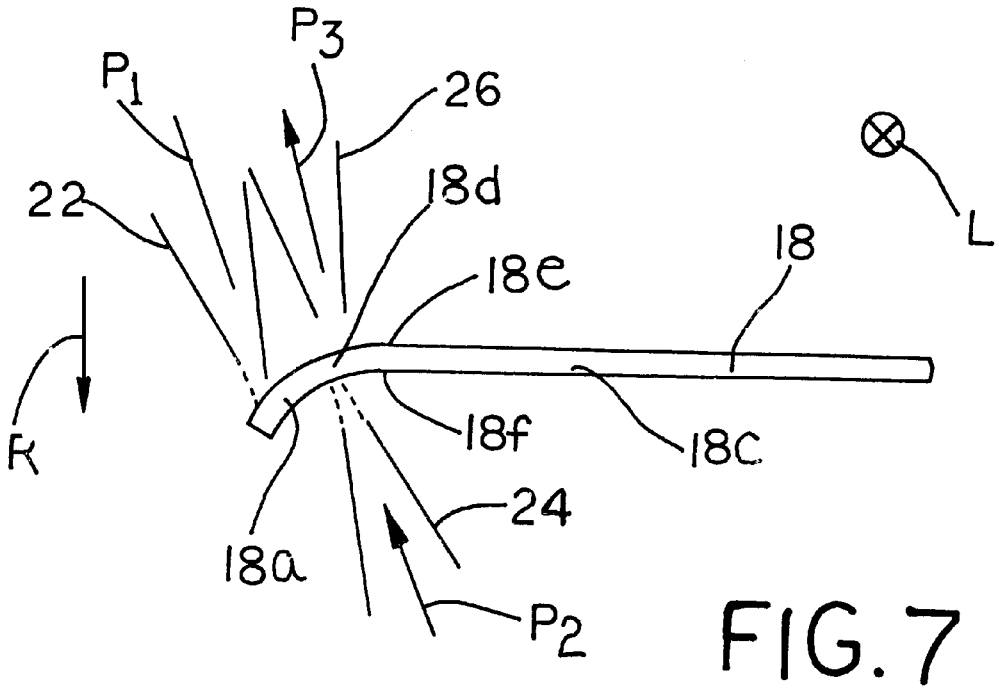
FIG. 7 shows a view similar to FIG. 3 of a deflection device operating by influencing the pressure conditions in the area of the edge strip.

Now, additionally referring to FIG. 7, edge strip 18*a* is deflected in the direction of arrow R by influencing the air pressure which, in the area of edge strip 18*a*, prevails on surface 18*e* facing curtain 16 of application medium 14 and/or surface 18*f* of web 18 lying opposite of surface 18*e*. To this end, a first blowing device 22 is provided which, on the side of surface 18*e*, ejects air (or another gas compatible with the application operation, for example nitrogen, carbon dioxide or the like) under pressure in the direction of arrow $P_1$, aimed at edge strip 18*a*. Blowing device 24 on the side of surface 18*f* expels compressed air in the direction of arrow $P_2$ onto transition region 18*d*, between edge strip 18*a* and useful strip 18*c* of web 18, in order to ensure that edge strip 18*a* is bent at the desired point.

In principle, stabilization of transition region 18*d* can also be ensured by a suction device 26, which sucks out air in the direction of arrow $P_3$ from transition region 18*d*. Alternatively, the function of blowing device 22 can also be replaced by a corresponding suction device on the other side of web 18.

Figure 8:
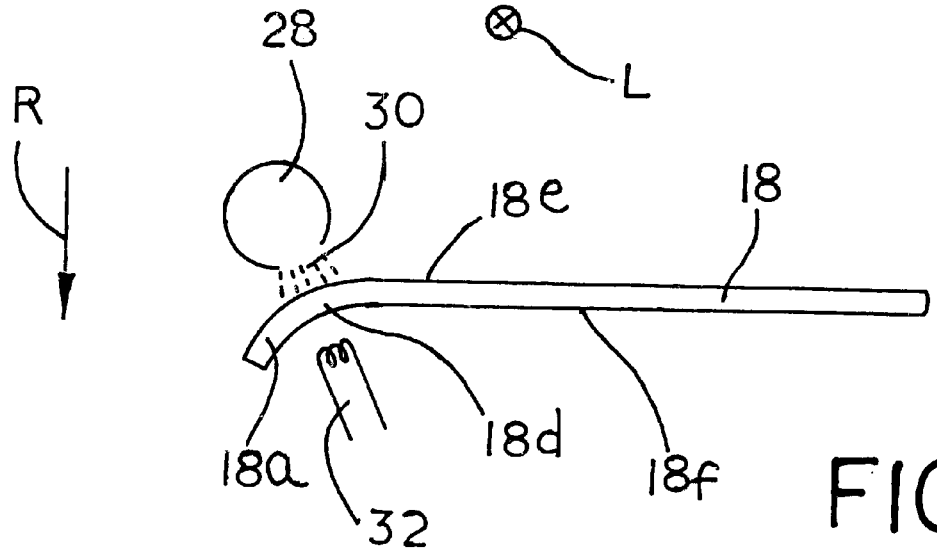
FIG. 8 shows a view similar to FIG. 3 of a deflection device that influences the moisture level of the web.

Now, additionally referring to FIG. 8, edge strip 18*a* is deflected by deliberate moistening and/or drying of web 18. In the embodiment shown, on the side of web 18 associated with surface 18*e*, a moistening device 28 is provided, which discharges moistening medium 30, preferably water, as a spray mist onto surface 18*e* of web 18. The aim of this moistening is to deliberately cause web 18 to swell in transition region 18*d*. On the other side of web 18, associated with surface 18*f*, a heating device 32 is shown which deliberately dries web 18. The intention of this drying is to achieve a desired contraction of web 18. The swelling of web 18 associated with the moistening and/or the contraction of web 18 associated with the drying in the area of surfaces 18*e* and 18*f* of web 18 have the effect of bending web 18 in the direction of arrow R.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for applying a coating of one of a liquid and pasty application medium onto a moving material web, comprising:

a curtain applicator configured to dispense an application medium as a curtain onto a material web; and a deflection device configured to prevent complete coating of at least one edge strip region of said material web with said application medium by deflecting said at least one edge strip of said material web proximate said curtain applicator.

2. The apparatus of claim 1, wherein said deflection device influences at least one of an amount of deflection and a contour of deflection of said at least one edge strip of said material web.

3. The apparatus of claim 1, wherein said deflection device deflects said at least one edge strip by an acute angle in an area where said application medium is dispensed.

4. The apparatus of claim 1, wherein said deflection device deflects said at least one edge strip by an obtuse angle in an area where said application medium is dispensed.

5. The apparatus of claim 1, wherein said deflection device deflects said at least one edge strip mechanically.

6. The apparatus of claim 1, wherein said deflection device comprises at least one deflection rod configured to act on a side of said at least one edge strip facing away from a direction of deflection.

7. The apparatus of claim 6, wherein said at least one deflection rod is a plurality of deflection rods arranged following one another in a direction of movement of said material web, said plurality of deflection rods configured to increasingly deflect said at least one edge strip, out of a plane defined by said material web, in a direction of movement of said material web.

8. The apparatus of claim 6, wherein said at least one deflection rod is made from a wear resistant material.

9. The apparatus of claim 6, further comprising a holder, said at least one deflection rod being detachably fitted to said holder.

10. The apparatus of claim 6, wherein said at least one deflection rod is arranged from about 1 cm to about 20 cm upstream from said curtain applicator in said direction of movement of said material web.

11. The apparatus of claim 1, wherein said deflection device comprises at least one deflection strip configured to act on a side of said at least one edge strip facing away from a direction of deflection to increasingly deflect said at least one edge strip, out of a plane defined by said material web, in a direction of movement of said material web.

12. The apparatus of claim 11, wherein said at least one deflection strip is made from a wear resistant material.

13. The apparatus of claim 11, further comprising a holder, said deflection strip being detachably fitted to said holder.

14. The apparatus of claim 11, wherein said deflection strip is arranged from about 1 cm to about 20 cm upstream from said curtain applicator in said direction of movement of said material web.

15. The apparatus of claim 1, wherein said deflection device deflects said at least one edge strip by influencing a pressure prevailing in an area of said at least one edge strip.

16. The apparatus of claim 15, where in said deflection device comprises at least one blowing device having a blowing nozzle disposed toward said at least one edge strip.

17. The apparatus of claim 16, wherein said blowing nozzle is disposed toward a transition region of said material web in a direction of deflection.

18. The apparatus of claim 15, where in said deflection device comprises at least one suction device having a suction nozzle disposed toward said at least one edge strip.

19. The apparatus of claim 18, wherein said suction nozzle of said suction device is aimed toward a transition region of said material web, said suction nozzle being disposed on a side of said material web which does not receive said application medium from said curtain applicator.

20. The apparatus of claim 1, wherein said deflection device comprises a web moisture influencing device configured to at least one of moisten and dry said material web in predetermined areas of said material web.

21. The apparatus of claim 20, wherein said web moisture influencing device acts on a transition region of said material web.

22. The apparatus of claim 1, wherein said deflection device is adjustably disposed with respect to said material web.

* * * * *